United States Patent [19]

Nelson

[11] Patent Number: 4,809,788

[45] Date of Patent: Mar. 7, 1989

[54] MAST ASSEMBLY FOR PERCUSSIVE AND AUGER DRILLING

[76] Inventor: Ivan L. Nelson, 217 W. Fayette, Osceola, Iowa 50213

[21] Appl. No.: 189,300

[22] Filed: May 2, 1988

Related U.S. Application Data

[63] Continuation of Ser. No. 935,514, Nov. 26, 1986, abandoned.

[51] Int. Cl.[4] ..... E21C 11/02

[52] U.S. Cl. ..... 173/28; 173/42; 173/46

[58] Field of Search ..... 173/22, 28, 29, 43, 173/46, 42; 175/108, 135, 203

[56] References Cited

U.S. PATENT DOCUMENTS

| | | | |
|---|---|---|---|
| 2,655,006 | 10/1953 | Hoen et al. | 173/43 X |
| 3,172,483 | 3/1965 | Spitzer | 173/28 |
| 3,447,613 | 6/1969 | Lisenby | 173/28 |
| 3,548,604 | 12/1970 | Campbell | 173/28 |
| 3,576,218 | 4/1971 | Lisenby | 173/28 |
| 3,696,625 | 10/1972 | Alexander | 173/46 X |
| 3,754,604 | 8/1973 | Inaba et al. | 173/28 |
| 3,771,610 | 11/1973 | Leyrat | 173/28 X |

*Primary Examiner*—Frank T. Yost
*Assistant Examiner*—James L. Wolfe
*Attorney, Agent, or Firm*—Henderson & Sturm

[57] ABSTRACT

A drilling mast assembly (20) mounted on a vehicle (24) for operation in a vertical position and comprising an elongated main mast (44), a secondary mast unit (46) swingably mounted on the main mast (44) for movement from a locked position aligned and contiguous with the main mast (44) to a position swung away from the main mast (44), percussive unit (48) mounted on the secondary mast unit (46) and having a sinker drill (48) movable vertically relative and parallel to the main mast (44) for forming an initial opening in a surface therebelow, and an auger unit (49) having an augar drill (51) mounted on the main mast (44) for vertical movement relative and parallel to the main mast (44) along a longitudinal axis aligned with the longitudinal axis of the percussive sinker drill (48).

1 Claim, 3 Drawing Sheets

MAST ASSEMBLY FOR PERCUSSIVE AND AUGER DRILLING

This is a continuation of co-pending application Ser. No. 935,514, filed on Nov. 26, 1986, now abandoned.

TECHNICAL FIELD

The present invention relates generally to a mechanism for drilling holes into pavement, soil and like surfaces to locate breaks in water mains, for example, and more particularly to a combined system including both a sinker drill and an auger drill mounted on a single mast unit.

BACKGROUND UNIT

The usual method for locating breaks in water mains below a hard surface, concrete for example, or a softer surface such as soil is to use manually operated pneumatic jack hammers, steamers and even brute force, i.e., pick axes and the like.

Contemporary methods now utilize drill towers mounted on many types of prime movers such as trucks, with the drill towers comprising twin masts, one mast mounting on air-powered rotary percussion drill and the other mast mounting a hydraulic powered auger. The towers are movable as a unit fore and aft a short distance, sixteen inches for example, and laterally the distance between their center lines. This method requires a continuous shifting of the entire twin-mast structure on its mounting unit for drilling a single hole.

DISCLOSURE OF THE INVENTION

The invention relates to a unique drilling system combining in a simplified and easily operated assembly the capability of performing both percussive and auger drilling methods without the necessity of moving the entire mast unit laterally.

The drilling system of this invention is adapted to be mounted on a prime mover such as a truck bed or a trailer, for operation normally in a vertical position, a source of air and hydraulic power being supplied by auxiliary equipment also mounted on the prime mover, and with the system comprising essentially a main mast, a secondary mast mounted on the main mast and swingably movable from a first locked position aligned and contiguous with the main mast to a second locked position swung laterally away from the main mast, percussive means mounted on the secondary mast for vertical movement relative thereto and to the main mast, and auger means mounted on the main mast for vertical movement thereon, the auger means moving along an axis or center line aligned with the axis or center line of movement of the percussive means.

It is thus an object of this invention to provide an improved multi-purpose drilling system for percussive and auger drilling.

It is another object of this invention to provide a novel drilling system which obviates the need for lateral movement of the main mast for both percussive and auger drilling.

Yet another object of this invention is to provide an efficient, effective and fast drilling system for utilization of a sinker drill and an auger drill, both drilling along the same axis or center line.

Still another object of this invention is to provide a drilling system utilizing both a sinker drill and an auger drill mounted on a single main mast for sequential drilling along a common center line.

Another object of this invention is the provision of a drilling system incorporating a single guide element at the foot of a single mast for guiding both a sinker drill and an auger drill, sequentially.

BRIEF DESCRIPTION OF THE DRAWINGS

These and other objectives of the invention will become readily apparent upon a thorough study and review of the following detailed description of the preferred embodiment for carrying out the invention, particularly in conjunction with the accompanying drawings, wherein.

BEST MODE FOR CARRYING OUT THE INVENTION

Figure 1:
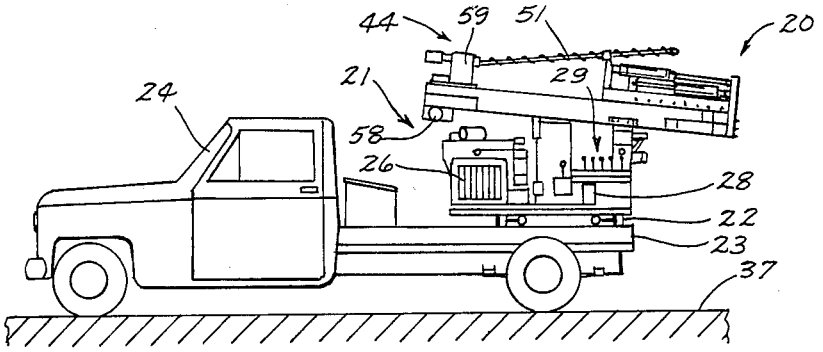
FIG. 1 is a reduced side elevation of a prime mover truck having mounted thereon the drilling system incorporating the mast assembly of this invention.

The drilling mast assembly of this invention is indicated generally at (20) in FIG. 1, and is part of a drilling system (21) mounted by means of a slide assembly (22) on the bed (23) of a conventional truck (24).

For operating hydraulic and air operated components of the mast assembly (20) in a conventional manner, the system (21) includes an engine (26), a hydraulic reservoir (27), a compressor (28), and a manually operated control lever unit (29), plus the normal hydraulic and pneumatic lines (not shown) interconnecting the various components for conventional operation.

Figure 2:
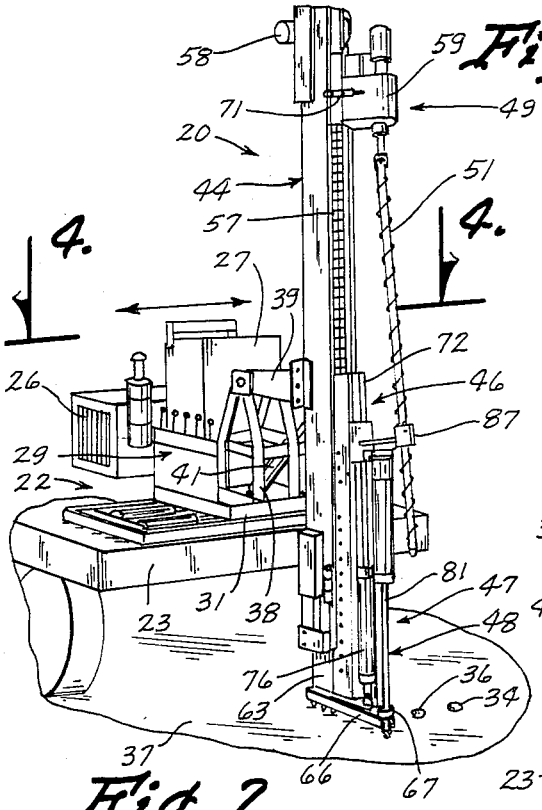
FIG. 2 is an enlarged perspective detail view showing the mast assembly of FIG. 1 in an operative vertical position.
Figure 4:
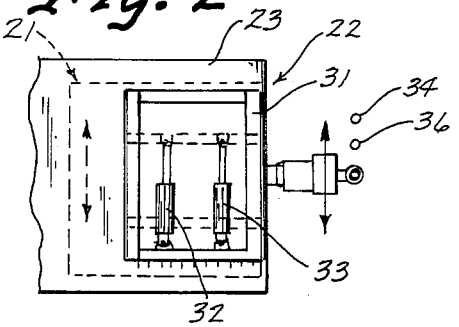
FIG. 4 is a detail plan view of the slide unit for moving the drilling system laterally of the vehicle, taken along the line 4—4 in FIG. 2.

The base (31) of the drilling system (21) is mounted in an interlocking manner in sliding engagement with the slide assembly (22) shown in full lines in FIGS. 2 and 4, the latter secured to the truck bed (23), and by means of a pair of piston and cylinder units (32), (33) interconnected between the base (31) and the slide assembly (22), the base (31) and thus the entire drilling system (21) is moved laterally back and forth relative to the truck bed (23) such that, for example, a plurality of laterally spaced holes (34), (36) can be drilled into the material (37) beneath the mast assembly (20).

Referring to FIG. 1, the mast assembly (20) is shown disposed in a generally horizontal position over the remainder of the system (21). This is provided by a mast supporting frame (38) connected to the base (31) and to which is mounted a mast tilt and swivel plate assembly indicated generally at (39), including further a piston and cylinder unit (41) interconnected between the frame (38) and the pivot plate (42) of the assembly (39), a mounting plate (43) securing the plate (42) to the mast assembly (20). With this arrangement, by operation of the cylinder unit (41), the mast assembly (20) can be moved from the horizontal position of FIG. 1 for transport purposes to the vertical position of FIG. 2 for drilling purposes and to any position therebetween temporarily. Further, by providing half-circle slots (not shown) in the pivot plate (42) with accommodating connections with the mounting plate (43), the mast assembly (20) can be rotated about a horizontal axis when disposed in the vertical position of FIGS. 2 and 3. By swinging the mast assembly off-hole, access is allowed to the borehole just drilled without lateral movement of the entire mast assembly (20).

Figure 3:
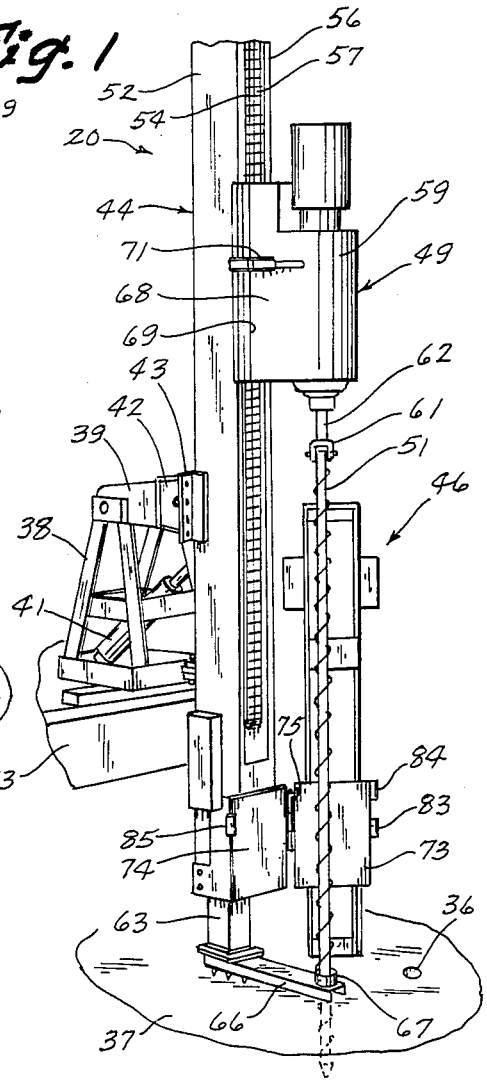
FIG. 3 is a view similar to FIG. 2, and with the percussive sinker drill unit swung laterally away from the main mast, and the auger drill lowered on the main mast for operation.
Figure 5:
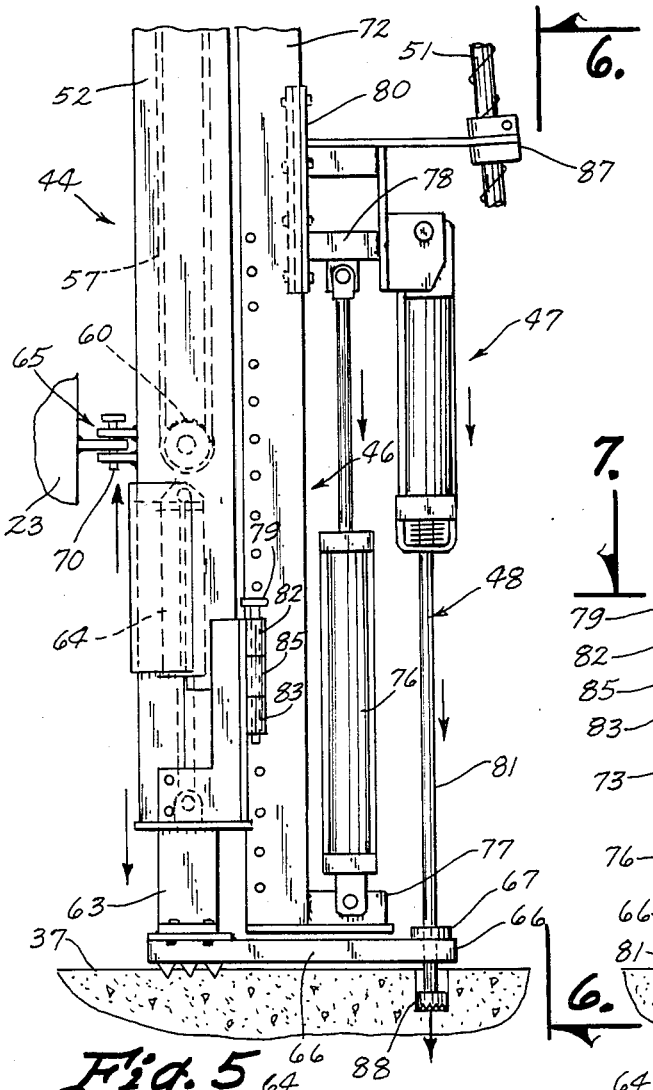
FIG. 5 is a further enlarged side elevational view of the main mast, and the secondary mast and percussive unit.

Referring particularly to FIGS. 2 and 3, generally the mast assembly (20) comprises: a first or main mast (44) mounted on the mast tilt and swivel plate assembly (39); a second shorter mast unit (46) hingedly mounted on the main mast (44) adjacent the base thereof and swingable laterally from a first position aligned with and contiguous to the mast (44) (FIG. 2) to a second position disposed to one side of the main mast (44) (FIG. 3); a percussive unit (47) mounted to the secondary mast unit (46) and including a sinker drill (48) (FIGS. 2 and 5) mounted for normally vertical movement relative and parallel to the longitudinal axis of the main mast (44); and an auger drill unit (49) including an auger drill (51) mounted on the main mast (44) for normally vertical movement relative and parallel to the longitudinal axis of the main mast (44).

More particularly, the main mast (44) is of basically conventional construction including a weldment having side plates (52), (53) with facing slide angles (54), (56) for housing an endless chain (57) mounted appropriately on a wheel (not shown) at the interior top of the mast (44) and an idler (60) (FIG. 5) at the interior base of the mast (44), a drive sprocket (not shown) drivingly engaged with the chain (57) and rotated by a hydraulic motor (58) mounted at the top of the mast (44).

A conventional drillhead and slide plate assembly (59) is slidably mounted on the main mast (44) in sliding engagement with the mast slide angles (54), (56) and drivingly engaged with said chain (57) for up and down vertical movement. The auger drill (51) is connected by a universal joint (61) to the spindle assembly (62) of the assembly (59). At the base (47) of the main mast (44), a mast foot (63) is slidably mounted in the mast (44), movable by a piston and cylinder (64) (FIG. 5) mounted within the mast (44). A guide plate (66) having a drill guide (67) formed in the outer end is secured to the foot (63), the guide (67) being axially aligned with the longitudinal axis of the auger drill (51) when the latter is extended parallel to the longitudinal axis of the main mast.

The drillhead assembly (59) includes further a drive box (68) which is hingedly mounted on a front side plate (69), and having a latch assembly (71) for either locking the drillhead assembly (59) together in the operative position of FIGS. 2 and 3, or for permitting the drive box (68) and the auger drill (51) to be swung away from the main mast (44). To lock the main mast (44) in its vertical position, a latching unit (65) including a removable pin (70) (FIG. 5) is provided on the mast (44) and the truck bed (23).

The secondary mast unit (46) comprises a box-type mast (72) having a mast support (73) hingedly mounted at (75) on a frame (74) which is secured to the main mast (44). To move the sinker drill (48) vertically, a cylinder unit (76) is connected between a base element (77) of the mast (72) and a pair of holders (78) secured to a slide assembly (79), the latter slidably mounted on the mast (72). At an outer portion of the holders (78), the upper end of the sinker drill (48) is mounted the drill (81) itself depended thereof for working extension through the guide (67). A Stanley SK 47 Sinker Drill is one commercial unit recommended for the sinker drill (48).

Figure 7:
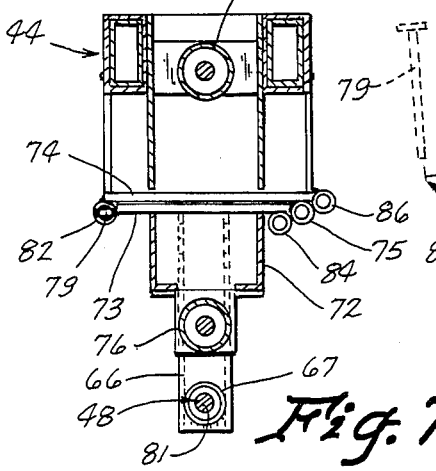
FIG. 7 is a horizontal sectional view taken along the line 7—7 in FIG. 6.
Figure 8:
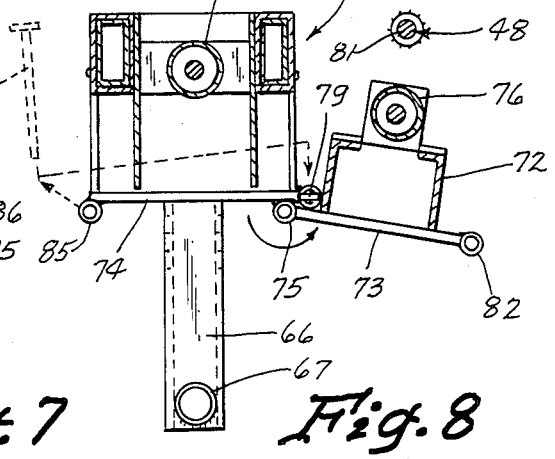
FIG. 8 is a view similar to FIG. 7 and with the percussive drill swung laterally away from the main mast.

The secondary mast unit (46) is held aligned with and contiguous to the main mast (44) in the FIGS. 2 and 7 locked position by a latch pin (79) inserted through the aligned hinges (81), (82) and (83) of the support (73) held flat against the frame (74); and then with the pin (79) removed, whereby the mast (72) is swung laterally away from the main mast (44), a hinge guide (84) on the support (73) is swung into alignment with an extra hinge guide (86) on the stationary frame (74) such that by placing the latch pin (79) through the guides (84), (86) the secondary mast unit (46) is held in the locked position (FIGS. 3 and 8) away from and out of the path of the auger drill (51).

To hold the auger drill (51) away from the secondary mast unit (46) during transportation or when the latter is operating, a drill guide (87) (FIG. 2) is provided and which is mounted to the front of the mast (72) for extension further out and away from the normal vertical longitudinal axis or center line of movement of the auger drill (51), and which axis or center line is vertically aligned with that of the percussive drill (48), it being understood that both drills (48) and (51) are arranged to sequentially move along and through aligned vertical longitudinal axis or common center lines for drilling the same hole. When the secondary mast unit (46) is swung away and out of the path of the main mast drillhead assembly (59), the drill guide (87) is removed leaving the auger drill (51) free to swing vertically downwardly for operative guiding by the foot guide (67) (FIG. 3).

Figure 6:
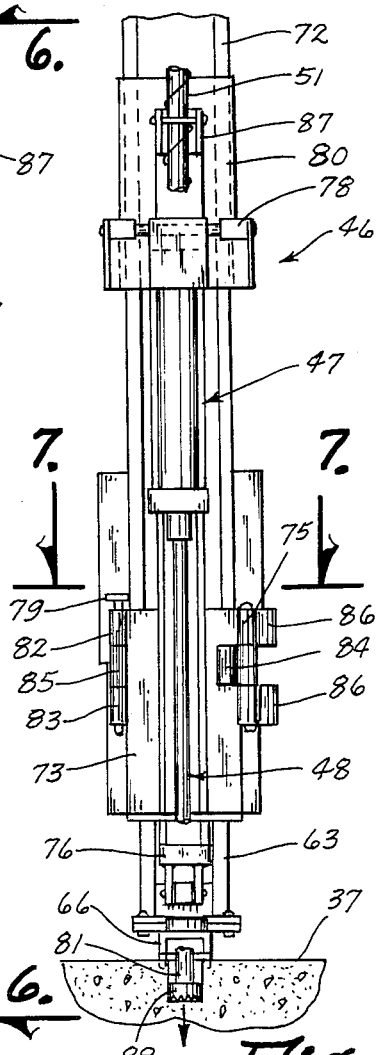
FIG. 6 is a front elevational view of the structure of FIG. 5.
Figure 9:
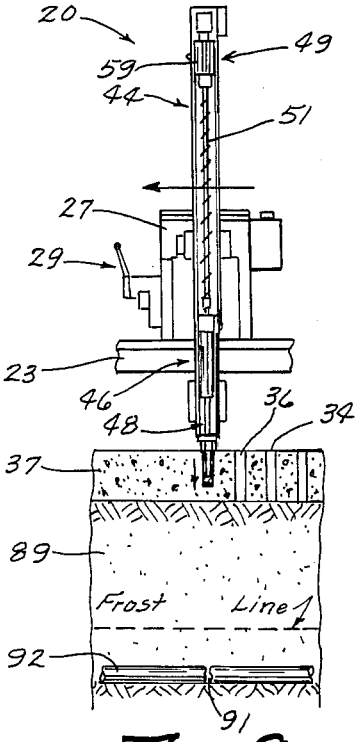
FIG. 9 is a pictorial view showing operation of the percussive drill of the invention into concrete.
Figure 10:
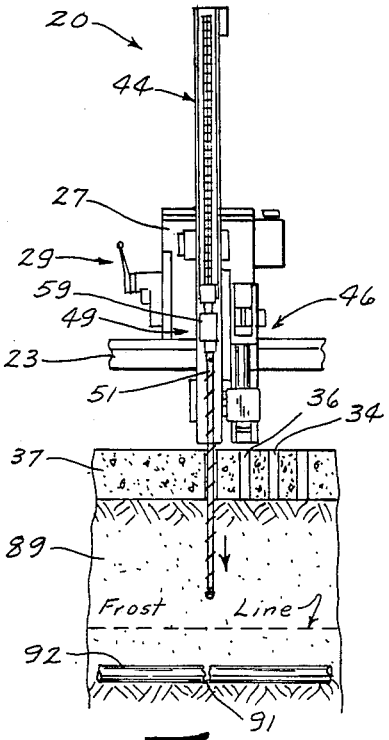
FIG. 10 is a pictorial view showing operation of the auger drill of the invention through the hole formed by the percussive drill and further downwardly into the soil toward a water main break.

Operation of the drilling mast assembly (20) is quite simple and expedient with the assembly (20) set up as shown in FIG. 2. Operation of the hydraulic percussive drill unit (49), having for example a two inch carbide tipped star bit (88) (FIGS. 5 and 6), quickly bores through a street surface material (37) (FIG. 9. After retracting the drill (48) by operation of the feed cylinder unit (76), the secondary mast (72) is unlatched from the main mast (44) and swung out of the way. The main mast (44) units are then operated to lower the auger drill (51) for guiding engagement through the plate guide (67) and for finish drilling through the soil (89) (FIG. 10). After the desired depth has been reached, normally to a position just above the break (91) in the water main (92), the auger drill (51) is retracted, and further operations by other equipment not a part of this invention are continued.

As mentioned hereinbefore, with the provisions of the lateral slide assembly (22), a series of holes (34), (36), (FIGS. 9 and 10), etc., can be accomplished without having to move the entire vehicle (24) and drilling system rig (21).

As various modifications of this invention will be apparent to those skilled in the art, the scope of this invention should be limited only by the appended claims.

I claim:

1. A drilling mast assembly adapted for mounting on a prime mover for operation in a vertical position, and a source of power provided therefor, the mast assembly comprising:

a first mast having a longitudinal axis;

a second mast having a longitudinal axis and swingably mounted on said first mast and movable from a first position aligned with said first mast to a second position to one side thereof;

percussive means mounted on said second mast for vertical movement relative thereto and parallel to said first mast axis;

power means mounted on said first mast for vertical movement thereon, said power means capable of transmitting rotational drive;

auger means;

universal joint means interconnected between said power means and said auger means to transmit rotatable drive from said power means to said auger means, and wherein said auger means is vertically movable parallel to said first mast axis upon movement of said power means;

said auger means movable via said universal joint means from a first position extended angularly away from said first mast when said second mast is in its said first position, to a second position extended parallel said first mast for operating purposes, said auger means assuming its said second position when said second mast is in its said second position; and bracket means mounted on said second mast for releasably holding said auger means in its said first position, said bracket means movable away from engagement of said auger means upon movement of said second mast to its said second position.

* * * * *